US012590471B2

(12) United States Patent
Thelin et al.

(10) Patent No.: US 12,590,471 B2
(45) Date of Patent: Mar. 31, 2026

(54) PORTABLE SHELTER

(71) Applicant: Dometic Sweden AB, Solna (SE)

(72) Inventors: Mikael Thelin, Huddinge (SE); Max Lawless, Colchester (GB)

(73) Assignee: Dometic Sweden AB, Solna (SE)

( * ) Notice: Subject to any disclaimer, the term of this patent is extended or adjusted under 35 U.S.C. 154(b) by 34 days.

(21) Appl. No.: 18/003,223

(22) PCT Filed: Jun. 24, 2021

(86) PCT No.: PCT/EP2021/067411

§ 371 (c)(1),
(2) Date: Dec. 23, 2022

(87) PCT Pub. No.: WO2021/260143

PCT Pub. Date: Dec. 30, 2021

(65) Prior Publication Data

US 2023/0323700 A1 Oct. 12, 2023

(30) Foreign Application Priority Data

Jun. 25, 2020 (GB) ..... 2009736

(51) Int. Cl.
*E04H 15/20* (2006.01)
*E04H 15/06* (2006.01)

(52) U.S. Cl.
CPC ..... *E04H 15/20* (2013.01); *E04H 15/06* (2013.01); *E04H 2015/201* (2013.01)

(58) Field of Classification Search
CPC .... E04H 15/20; E04H 15/06; E04H 2015/201
See application file for complete search history.

(56) References Cited

U.S. PATENT DOCUMENTS 1,964,818 A * 7/1934 Hood ..... E04H 15/20 52/2.21
3,367,063 A 2/1968 Erik et al.
(Continued)

FOREIGN PATENT DOCUMENTS

AT 194142004 8/2010
AU 2004202955 A1 4/2005
(Continued)

OTHER PUBLICATIONS

Design U.S. Appl. No. 29/763,385 titled Tent, filed Dec. 22, 2020.
(Continued)

*Primary Examiner* — Paola Agudelo
(74) *Attorney, Agent, or Firm* — Dinsmore & Shohl LLP

(57) ABSTRACT

Portable shelters and in particular to portable shelters including an inflatable support structure. A portable shelter provides an inflatable support structure including a single interconnected passage for air, the passage comprising four substantially straight post portions defining upright corner posts of the support structure and a roof formation connecting upper ends of the post portions and having at least two interconnecting tubes, an intersection between said at least two interconnecting tubes defining an apex of the roof formation; at least one flexible roof panel extending between the intersecting tubes of the roof formation to form a roof of the shelter; and openings between each of the neighboring post portions, the openings being substantially square and having a minimum dimension of 1800 mm when the shelter is in a fully inflated configuration, and wherein an average angle of inclination of the roof, between the upper ends of the post portions and the apex of the roof formation, is less than 15°.

23 Claims, 7 Drawing Sheets

(56) References Cited

U.S. PATENT DOCUMENTS

| | | | | |
|---|---|---|---|---|
| 3,526,067 | A | 9/1970 | Furter et al. | |
| 3,623,243 | A | 11/1971 | Hick | |
| 3,871,146 | A | 3/1975 | Hamy | |
| 4,171,595 | A * | 10/1979 | Tucker | A47K 3/325 52/2.21 |
| 4,197,681 | A * | 4/1980 | Holcombe | E04C 3/005 52/2.21 |
| 4,959,901 | A * | 10/1990 | Parish | E04H 15/20 135/900 |
| 5,394,897 | A * | 3/1995 | Ritchey | E04H 15/18 52/79.8 |
| 5,549,129 | A * | 8/1996 | Becker | E04F 10/0681 135/88.13 |
| 5,558,145 | A | 9/1996 | Baka | |
| 5,570,544 | A * | 11/1996 | Hale | E04H 15/20 52/2.18 |
| 5,752,536 | A | 5/1998 | Becker | |
| 5,970,661 | A | 10/1999 | Bishop et al. | |
| D427,730 | S | 7/2000 | Powers et al. | |
| 6,840,568 | B2 | 1/2005 | Carrillo et al. | |
| D511,196 | S | 11/2005 | Wehner | |
| 7,100,625 | B2 | 9/2006 | Valles | |
| 7,396,064 | B2 | 7/2008 | Hicks | |
| D621,100 | S | 8/2010 | Simpson et al. | |
| 8,096,082 | B2 * | 1/2012 | Moran | E04H 1/1244 52/2.25 |
| 8,615,966 | B2 * | 12/2013 | Thompson | A63H 33/008 446/221 |
| 8,752,565 | B2 | 6/2014 | McConnell et al. | |
| D740,442 | S | 10/2015 | Cohen et al. | |
| D744,053 | S * | 11/2015 | Cirjak | D21/835 |
| D745,978 | S | 12/2015 | Cohen et al. | |
| D754,266 | S | 4/2016 | Ross | |
| D754,267 | S | 4/2016 | Ross | |
| 9,755,408 | B2 | 9/2017 | Taylor | |
| 10,753,118 | B2 * | 8/2020 | Vesper | E04H 15/18 |
| D942,924 | S | 2/2022 | Doughty | |
| 11,653,772 | B2 * | 5/2023 | Goff | A47D 15/003 5/97 |
| 2002/0083653 | A1 * | 7/2002 | Hilbert | E04H 15/20 52/2.17 |
| 2003/0000563 | A1 | 1/2003 | Kuperman | |
| 2004/0168714 | A1 | 9/2004 | Zheng | |
| 2004/0194723 | A1 | 10/2004 | Farmer et al. | |
| 2006/0102219 | A1 * | 5/2006 | Broderick | E04H 15/003 135/117 |
| 2006/0283493 | A1 | 12/2006 | Charles | |
| 2009/0298385 | A1 | 12/2009 | Brinckerhoff | |
| 2011/0094555 | A1 | 4/2011 | Franta | |
| 2011/0155197 | A1 | 6/2011 | Hicks et al. | |
| 2011/0237155 | A1 | 9/2011 | Leung | |
| 2015/0337557 | A1 * | 11/2015 | Youn | E04H 15/18 135/97 |
| 2016/0201351 | A1 * | 7/2016 | Pirkle | E04H 15/20 135/121 |
| 2017/0036133 | A1 | 2/2017 | Moffett et al. | |
| 2017/0089092 | A1 * | 3/2017 | Krenzel | E04H 15/50 |
| 2017/0114566 | A1 | 4/2017 | Zheng | |
| 2017/0232357 | A1 | 8/2017 | Rosen et al. | |
| 2018/0137844 | A1 | 5/2018 | Schmick et al. | |
| 2019/0234098 | A1 | 8/2019 | Hanley | |
| 2020/0080333 | A1 | 3/2020 | Zahn et al. | |
| 2020/0270893 | A1 | 8/2020 | Aloumanis et al. | |
| 2021/0396037 | A1 | 12/2021 | Furseth et al. | |
| 2022/0104438 | A1 | 4/2022 | Wolf | |

FOREIGN PATENT DOCUMENTS

| | | | |
|---|---|---|---|
| AU | 2005239618 | | 6/2006 |
| AU | 2004202955 | | 1/2010 |
| AU | 2010241536 | | 7/2011 |
| AU | 2010241536 | A1 | 7/2011 |
| AU | 2019100949 | A4 | 10/2019 |
| AU | 2021298170 | | 2/2023 |
| AU | 2021354909 | | 4/2023 |
| CN | 200958293 | Y | 10/2007 |
| CN | 217300080 | | 8/2022 |
| CN | 115720602 | | 2/2023 |
| CN | 115720602 | A | 2/2023 |
| CN | 116234965 | | 6/2023 |
| DE | 7517054 | U | 11/1975 |
| DE | 19506200 | A1 | 8/1996 |
| DE | 602004028318 | | 9/2010 |
| DE | 102018208370 | | 11/2018 |
| DE | 102021210853 | | 4/2022 |
| EM | 015009069 | | 1/2023 |
| EP | 1439091 | A2 | 7/2004 |
| EP | 1516981 | | 3/2005 |
| EP | 1516981 | A1 | 3/2005 |
| EP | 2341197 | | 7/2011 |
| EP | 2341197 | A2 | 7/2011 |
| EP | 3272972 | | 1/2018 |
| EP | 3272972 | A1 | 1/2018 |
| EP | 3660243 | | 6/2020 |
| EP | 4150175 | | 3/2023 |
| EP | 4204646 | | 7/2023 |
| FR | 056146-001 | | 2/2006 |
| GB | 2104934 | A | 3/1983 |
| GB | 2552387 | | 10/2021 |
| GB | 2596338 | | 12/2021 |
| GB | 2599429 | | 4/2022 |
| GB | 2599431 | | 4/2022 |
| GB | 2599640 | | 4/2022 |
| JP | 07158322 | | 6/1995 |
| JP | 08042195 | | 2/1996 |
| JP | H1037535 | A | 2/1998 |
| WO | 2007118193 | A2 | 10/2007 |
| WO | WO2021260143 | | 12/2021 |
| WO | WO2022069640 | | 4/2022 |

OTHER PUBLICATIONS

Design U.S. Appl. No. 29/763,400 titled Tent, filed Dec. 22, 2020.
U.S. Appl. No. 18/247,410 titled Portable Shelter System, filed Mar. 30, 2023.
Design U.S. Appl. No. 29/868,338 titled Tent, filed Nov. 30, 2022.
Design U.S. Appl. No. 29/879,916 titled Tent, filed Jul. 14, 2023.
DOMETIC | HUB—Inflatable Outdoor Activity Shelter. Date Uploaded: Mar. 30, 2021. Retrieved from internet: <https://www.youtube.com/watch?v=VGK8ts97m4l> [site visited Jun. 15, 2022] (Year: 2021).
DOMETIC HUB Air 2 Review 2022. Date Uploaded: Oct. 31, 2021. Retrieved from internet: <https://www.youtube.com/watch?v=X8FXlcjqwQc> [site visited Jun. 15, 2022] (Year: 2021).
Australian Patent Application 202016868 entitled "Activity Hub" filed on Dec. 17, 2020.
Australian Patent Application 202016869 entitled "Activity Hub" filed on Dec. 17, 2020.
Australian Patent Application 202016870 entitled "Activity Hub" filed on Dec. 17, 2020.
Australian Patent Application 202016871 entitled "Activity Hub" filed on Dec. 17, 2020.
U.S. Appl. No. 29/763,400 entitled "Tent", filed Dec. 22, 2020.
U.S. Appl. No. 29/763,385 entitled "Tent", filed Dec. 22, 2020.
European Patent Application 008022289-0001 entitled "Activity Hub L" filed on Jun. 25, 2020.
European Patent Application 008022289-0002 entitled "Activity Hub L" filed on Jun. 25, 2020.
European Patent Application 008022289-0003 entitled "Activity Hub L" filed on Jun. 25, 2020.
European Patent Application 008022289-0004 entitled "Activity Hub L" filed on Jun. 25, 2020.
European Patent Application 008022289-0005 entitled "Activity Hub L" filed on Jun. 25, 2020.
European Patent Application 008022289-0006 entitled "Activity Hub L" filed on Jun. 25, 2020.
Notification of Registration for European Patent Application No. 008022289-0001-0006 mailed on Jun. 29, 2020.

(56) References Cited

OTHER PUBLICATIONS

UK Patent Application 2009736.6 entitled "Activity HUB (Kampa)" filed on Dec. 22, 2020.
UKIPO Search Report for UK Application 2009736.6 dated Nov. 30, 2020.
Chinese Patent Application 202030808932.5 entitled "Activity Hub" filed on Dec. 23, 2020.
United Kingdom Design Application No. 6157482 titled "Car Tent" filed on Aug. 27, 2021.
United Kingdom Design Application No. 6157483 titled "Car Tent" filed on Aug. 27, 2021.
United Kingdom Design Application No. 6157484 titled "Car Tent" filed on Aug. 27, 2021.
United Kingdom Design Application No. 6157485 titled "Car Tent" filed on Aug. 27, 2021.
United Kingdom Design Application No. 6157486 titled "Car Tent" filed on Aug. 27, 2021.
United Kingdom Design Application No. 6157487 titled "Car Tent" filed on Aug. 27, 2021.
PCT Application No. PCT/EP2021/067411 titled "Portable Shelter" filed on Jun. 24, 2021.
Non Final Office Action Mailed in U.S. Appl. No. 29/763,400 on Jul. 14, 2022.
Non Final Office Action Mailed in U.S. Appl. No. 29/763,385 on Jul. 14, 2022.
Australian Patent Application No. 2021298170 titled "Portable shelter" filed on Dec. 6, 2022.
Notice of Allowance Mailed in U.S. Appl. No. 29/763,385 on Nov. 25, 2022.
Notice of Allowance in U.S. Appl. No. 29/763,400 on Nov. 28, 2022.
EP Patent Application No. 21736589.9 titled "Portable shelter" filed on Dec. 14, 2022.
Corrected Notice of Allowance Mailed in U.S. Appl. No. 29/763,385 on Jan. 24, 2023.
Corrected Notice of Allowance Mailed in U.S. Appl. No. 29/763,400 on Jan. 24, 2023.
Notification of Grant Issued in Chinese Application No. 202030808932.5 mailed on Apr. 20, 2021.
Office action issued in EP Application No. 21736589.9 mailed on Nov. 2, 2023.
Mi-Camp ONE Inflatable tent <URL: https://web.archive.org/web/20190407220334/https://www.mi-camp.com/one-modular-interchangeable-camping-tent> published on Apr. 7, 2019, Retrieved from internet on Jan. 31, 2024.
Examination Report Issued in AU Application No. 2021298170 on Feb. 2, 2024.
Chinese Patent Application 202180044758.3 titled "Portable shelter" filed on Dec. 22, 2022.
Notice of Allowance issued in U.S. Appl. No. 29/763,385 mailed on Mar. 23, 2023.
Notice of Allowance issued in U.S. Appl. No. 29/763,400 mailed on Apr. 4, 2023.
Notice of Allowability issued in U.S. Appl. No. 29/763,400 mailed on May 24, 2023.
Notice of Allowability issued in U.S. Appl. No. 29/763,385 mailed on May 24, 2023.
Corrected Notice of Allowability issued in U.S. Appl. No. 29/763,400 mailed on Jun. 20, 2023.
Corrected Notice of Allowability issued in U.S. Appl. No. 29/763,385 mailed on Jun. 20, 2023.
Office Action issued in EP Application No. 21736589.9 mailed on Jun. 24, 2024.
Office Action issued in GB Application No. 2009736.6 mailed on Apr. 19, 2024.
ISA/European Patent Office; International Search Report and Written Opinion issued in PCT/EP2021/067411 mailed Oct. 4, 2021 Oct. 4, 2021.
European Design App. No. 004745651-0005 filed Aug. 3, 2018.
Www.mi-camp.com: The Easy to Pitch Mi-Camp ONE Inflatable Tent; https://www.mi-camp.com/one-modular-interchangeable-camping-tent/; Nov. 9, 2022.
Indiegogo: ONE—Easy to Pitch Tent Just The Way You Want It!; https://www.indiegogo.com/projects/one-easy-to-pitch-tent-just-the-way-you-want-it/x/17587992#/; Nov. 9, 2022.
Interntional Bureau; PCT Communication issued in PCT/EP2021/067411; Third Party Observation mailed Sep. 13, 2022.
Australian Patent Application No. 2025200685 titled "Portable shelter" filed on Jan. 31, 2025.
European Patent Office; Communication pursuant to Article 94(3) EPC issued Feb. 5, 2025.
Perry Benjamin: "Mi-Camp ONE Inflatable Tent", filed by third party, Mar. 14, 2018 (Mar. 14, 2018), XP093095254, Retrieved from the internet: URL: https://batavia.internal.epo.org/search-service-layer-master/v4/api-images/documents/XP/093095254/formats/original-pdf [retrieved on Dec. 25, 2022].
Examination Report Issued in GB Application No. 2009736.6 on Oct. 22, 2024.
Office Action issued in CN Application No. 202180044758.3 mailed on Apr. 30, 2025.
Examination Report issued in AU Application No. 2025200685 mailed on May 15, 2025.
Qube Tents for Modular Camping [retrieved from internet on Apr. 5, 2025] <URL: https://gearjunkie.com/camping/tents/connected-qube-tent> published on Mar. 6, 2017.
Gong et al, ."New Mobile Cabin Combination Design" Special Purpose Vehicle, Issue 05. May 15, 2015.
Australian Patent Application No. 2025287305 titled "Portable shelter" filed on Dec. 23, 2025.

* cited by examiner

PORTABLE SHELTER

This 35 U.S.C. § 371 National Stage Patent Application claims priority to PCT Patent Application No. PCT/EP2021/067411, filed Jun. 24, 2021, which claims priority to and benefit of GB Patent Application Serial Number 2009736.6, filed Jun. 25, 2020, all of which is incorporated by reference herein.

FIELD OF THE INVENTION

The present embodiments relate to portable shelters and in particular to portable shelters including an inflatable support structure. Also disclosed is a modular system comprising one or more portable shelters. The modular system may allow interconnection of more than one portable shelter. The modular system may allow connection of the portable shelter to another structure such as a vehicle. The vehicle may be a caravan, a motorhome or a sport utility vehicle (SUV), for example.

BACKGROUND TO THE INVENTION

Portable and collapsible structures such as tents and awnings may be connected to a vehicle such as a caravan, a motorhome or a sport utility vehicle (SUV) to provide a shelter and/or an extension to the existing accommodation.

It is desirable for these shelters to be compact in their collapsed configuration so that they occupy minimal space in the vehicle during transportation. It is also desirable for the shelter to be quick and easy to erect.

One type of shelter uses poles to form the support structure or skeleton of the shelter. The poles may be rigid or flexible and are often made from a metal, such as steel or aluminium, a polymer, or a composite such as fibreglass or carbon fibre. A second type of shelter replaces the poles with hollow tubes or beams which are inflated to form the erected structure. Whether the skeleton of the shelter includes poles or hollow tubes, the shelter will also include a flexible layer or sheet forming the walls and roof of the shelter which is connected to and supported by the skeleton.

It is now increasingly common to find shelters such as these which can be connected together to form larger shelters or shelters having multiple compartments. These modular shelters may provide separate living and sleeping areas for example. Typically these modular shelters will include one or more areas or compartments having a first, greater height and one or more areas or compartments having a second, smaller height. The areas having a greater height are typically used as living areas, while compartments having a lower height may be used as connecting regions between compartments or for sleeping compartments.

A disadvantage of these known systems is that they are often complex in design and require multiple different elements to create a modular shelter. This makes them complex and difficult to erect.

Against this background it is desirable to provide a portable shelter that is quick and easy to erect, and which may form part of a modular system.

SUMMARY OF THE INVENTION

A first aspect of the present invention provides a portable shelter comprising:

an inflatable support structure including a single interconnected passage for air, the passage comprising four substantially straight post portions defining upright corner posts of the support structure and a roof formation connecting upper ends of the post portions and having at least two interconnecting tubes, an intersection between said at least two interconnecting tubes defining an apex of the roof formation;

at least one flexible roof panel extending between the intersecting tubes of the roof formation to form a roof of the shelter; and openings between each of the neighboring post portions, the openings being substantially square and having a minimum dimension of 1800 mm when the shelter is in a fully inflated configuration, and wherein an average angle of inclination of the roof, between the upper ends of the post portions and the apex of the roof formation, is less than 15°.

A length of each of the post portions of the support structure may be substantially equal to a distance between neighboring post portions.

In some embodiments a first end of each of the post portions is a closed end and forms a lower end of the support structure when the support structure is inflated and erected.

The inflatable support structure may comprise a single inflation point. The inflation point may be disposed proximate one of the first ends of the post portions.

The intersection may be centrally disposed in the roof formation.

The flexible roof panel may fully span an area defined by the upper ends of the corner posts. The roof panel may extend outwardly to a substantially square-shaped perimeter of the roof panel comprising four edges. Each of the four edges may extend between two neighboring corner posts.

An average angle of inclination of the roof may be between about 5° and about 15°.

In some embodiments the shelter comprises flexible strips extending between first, lower ends of neighboring corner posts. So that the shelter automatically assumes a desired cube-like shape when erected, a length of each of the flexible strips may be the same. The length of each of the flexible strips may be equal to a length of each of the edges of the roof panel in embodiments in which the roof panel is substantially square.

The flexible strips may form part of a lower perimeter band of the shelter.

The portable shelter may further comprise a plurality of pouches having an internal volume fillable with a substance, such as sand or water. The pouches may be disposed in corner regions of the lower perimeter band. The corner pouches may be separate from and securable to the lower perimeter band. Alternatively, the pouches may be integrally formed with the lower perimeter band. In use, filled pouches may be seated on corner portions of the lower perimeter band to secure lower corners of the portable shelter to the ground.

In some embodiments the shelter may further comprise a detachable groundsheet. An internal edge of the lower perimeter band may include a fastener configured to engage and connect with a corresponding fastener of the detachable groundsheet. The fastener may be in the form of a zip, but may be of any suitable form such as press studs or hook and loop material, or the like. In other embodiments the groundsheet may not be detachable and may be integrally formed with the perimeter band.

A distance between opposite side edges of each of the openings may be greater than 1.8 metres. For example, the distance between opposite side edges of each of the openings may be between about 1.8 metres and about 2.5 metres, and more preferably between about 2 metres and about 2.2 metres. The distance between opposite side edges of each of the openings may be about 2.1 metres.

A minimum height of each of the openings between the ground or the lower perimeter band and an edge of the roof panel may be greater than about 1.8 metres. For example, a height of each of the openings may be between about 1.8 metres and about 2.5 metres, more preferably between about 2 metres and about 2.2 metres. The height of each of the openings may be 2.1 metres.

The shelter may further comprise wing panels extending from each of the post portions of the support structure. A free edge of each of the wing panels may form a side edge of one of the openings of the shelter. The free edges of the wing panels may form at least part of a continuous perimeter edge of each of the openings. The perimeter edge of each of the openings may include a fastener. The fasteners at the perimeter edges may be configured to engage with each other such that, for example, a first fastener around a first perimeter edge of a first opening of a first shelter may be engaged with a second fastener around a second perimeter edge of a second opening of a second shelter so as to join the first shelter to the second shelter. The fastener may be a zipper. The fastener may comprise press studs or hook and loop material.

A second aspect provides a modular shelter assembly comprising:

- a portable shelter according to the first aspect of the invention; and
- a detachable side module connected to the portable shelter.

The side module may comprise a fastener configured to engage with the fastener of the perimeter edge of each of the openings.

The side module may comprise a single flexible panel. The panel may include a window or a door. The panel may include a removeable or openable insert or sub-panel.

In other embodiments, the side module may be configured to connect the portable shelter to a vehicle. This side module may comprise a flexible sheet extending between a first edge and a second edge. The first edge may include a fastener configured to engage with the fastener of the perimeter edge of the opening of the portable shelter. The second edge may be elasticated, so that the second edge is able to conform to a shape of a vehicle. The second edge may include securing means configured to connect and secure the sheet to a vehicle. The securing means may comprise one or more of a strap, a suction cup, a ratchet and a buckle.

In other embodiments the side module may be in the form of a pod. The pod may comprise one or more flexible sheets arranged to provide a roof portion, two side wall portions, an end wall portion and a floor portion. The pod may comprise a connecting edge including a fastener configured to engage with the fastener of the perimeter edge of the opening of the portable shelter.

The pod may comprise a support structure. The support structure may comprise semi-rigid or rigid poles or inflatable hollow tubes. A height of the pod, i.e. a distance between the roof portion and the floor portion when erected, may be less than a height of the portable shelter, i.e. a distance between the ground and the apex of the portable shelter. In some embodiments a maximum height of the pod may be the same as or less than the height of the opening of the portable shelter.

In other embodiments the side module may be in the form of a through passage side module configured to extend between and connect two portable shelters. The through passage side module may comprise one or more flexible panels configured to form a tube extending between a first end and a second end. Each of the first end and the second end may have a perimeter having a length equal to the length of the perimeter edge of the opening of the portable shelter. Each of the first and second ends may comprise a fastener configured to engage with a fastener of a perimeter edge of an opening of the portable shelter.

In some embodiments the through passage side module comprises a first side wall portion and a second side wall portion. A length of the first side wall portion may be less than a length of the second side wall portion, such that a plane of the first end of the through passage side module is not parallel to a plane of the second end of the through passage side module.

A third aspect provides a method of erecting a shelter comprising:

- securing first ends of four corner post portions of a portable shelter on the ground such that distances between neighboring corner post portions are substantially equal and the first ends of the corner post portions are at least 1800 mm apart; and
- inflating a support structure of the portable shelter, the support structure including a single interconnected passage for air comprising the four corner post portions and a roof formation connecting second ends of the post portions, an intersection between at least two interconnecting tubes of the roof formation defining an apex of the roof formation,
- wherein, when the support structure is fully inflated, an integral flexible roof panel extends between the intersecting tubes of the roof formation to form a roof of the portable shelter, openings between each of the neighboring corner post portions are substantially square, and an average angle of inclination of the roof, between the second ends of the corner post portions and the apex of the roof formation, is less than 15°.

In some embodiments the method may comprise, before securing first ends of four corner post portions of the shelter on the ground, extending flexible strips between the first ends of neighboring corner post portions. The extended flexible strips may form a lower perimeter band of the portable shelter.

The method may further comprise filling an internal volume of a plurality of pouches with a substance, and disposing the pouches at corner regions of the lower perimeter band so as to weigh down said corner regions and secure the first ends of the four corner post portions of the portable shelter on the ground. The pouches may be filled with sand or water.

The method may further comprise connecting a pump to a single inflation point of the support structure of the portable shelter.

The method may further comprise attaching one or more side modules to the portable shelter. The method may comprise engaging a fastener of the side module with a fastener disposed at a perimeter edge of each of the openings between neighboring corner post portions.

BRIEF DESCRIPTION OF THE DRAWINGS

The invention will now be further described by way of example only and with reference to the accompanying drawings, in which.

DESCRIPTION OF THE EMBODIMENTS

Figure 1:
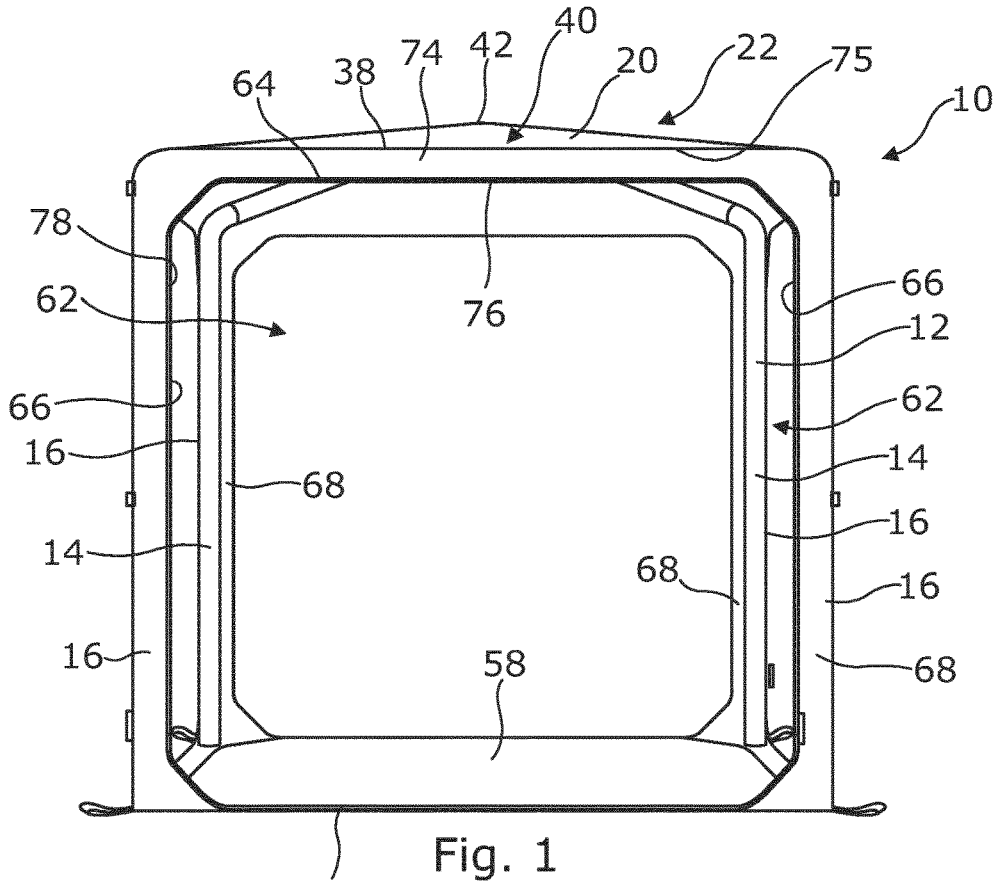
FIG. 1 is a perspective view of a portable shelter according to an example embodiment.
Figure 2:
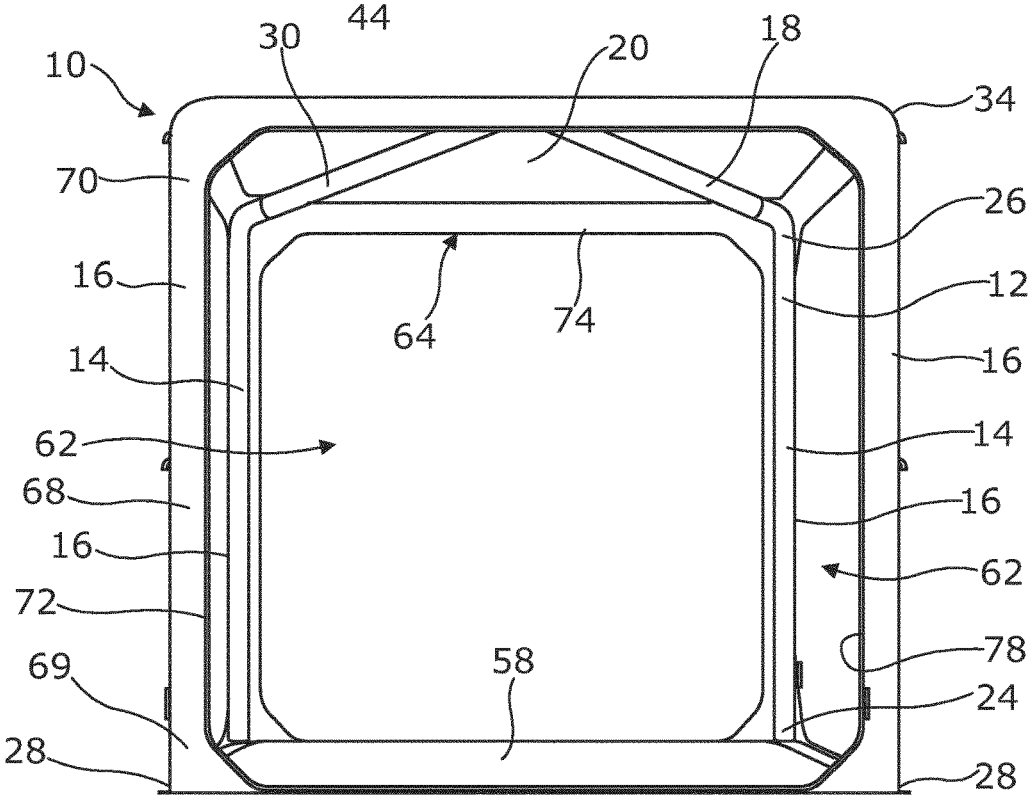
FIG. 2 is a further perspective view of the portable shelter of FIG. 1 showing in particular a part of an inflatable support structure of the shelter.
Figure 3:
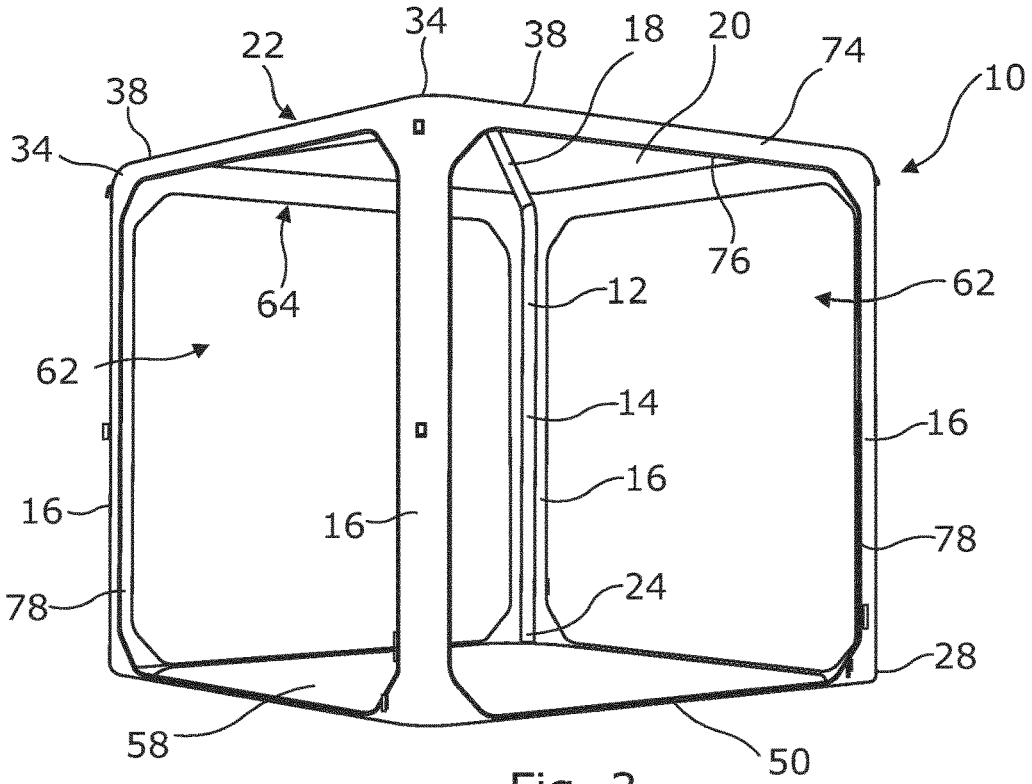
FIG. 3 is a further perspective view of the portable shelter of FIG. 1 showing in particular the configuration of a corner post of the shelter.
Figure 4:
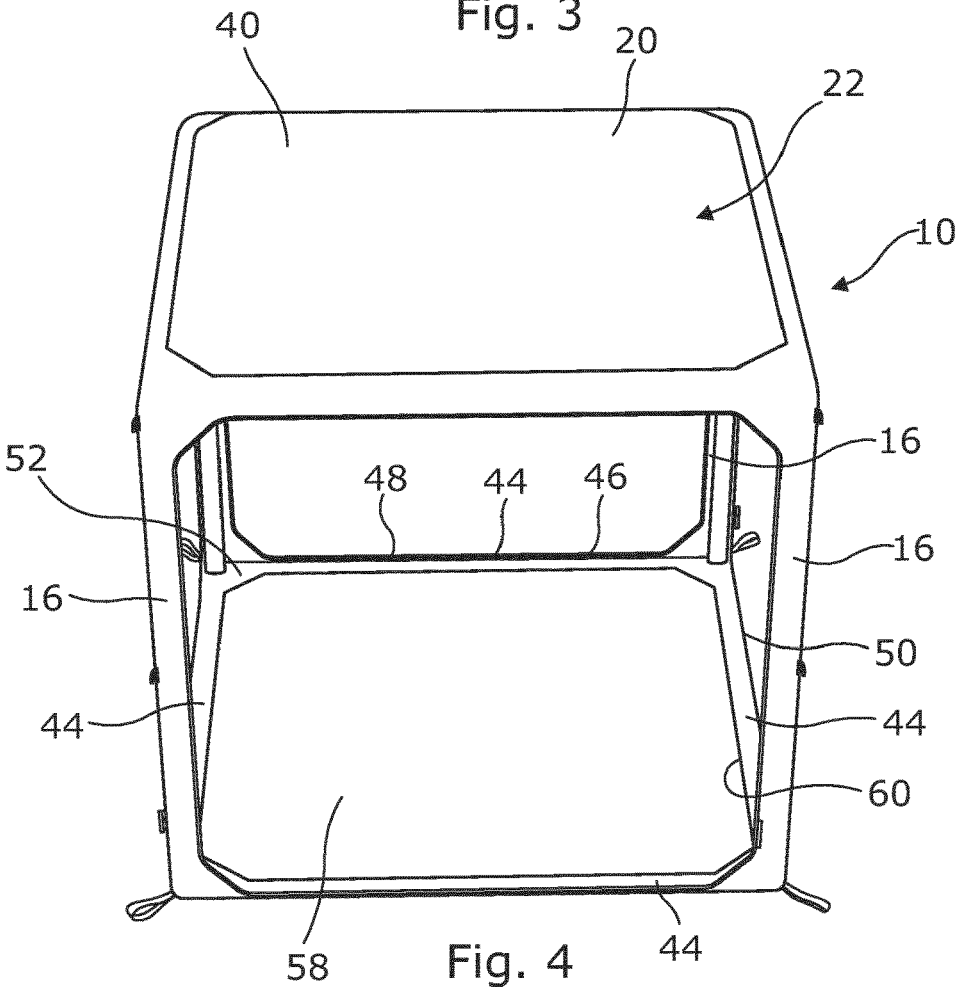
FIG. 4 is a further perspective view of the portable shelter of FIG. 1 showing in particular a roof of the shelter.

A first embodiment of a portable shelter 10 according to the invention is illustrated in FIGS. 1 to 4. The portable shelter 10 comprises an inflatable support structure 12 that forms a frame or skeleton of the shelter 10. The support structure 12 comprises four substantially straight post portions 14 defining corner posts 16 of the shelter 10 and a roof formation 18 extending from and connecting the post portions 14.

The shelter 10 further comprises a flexible roof panel 20 that, together with the roof formation 18, forms a roof 22 of the shelter 10. The roof panel 20 may be connected to the roof formation 18 of the support structure 12.

The portable shelter 10 is convertible from a collapsed or deflated configuration to an inflated and erect configuration by inflation of the support structure 12. The design of the shelter 10 may be such that the shelter 10 is as compact as possible in the collapsed configuration, such that the shelter 10 is suitable for storage and transportation, and provides a useful multi-functional space when erect.

It will be appreciated that FIGS. 1 to 4 shown the shelter 10 in its fully inflated and erect configuration. The support structure 12 may be configured so that the resultant erected shelter 10 is substantially cube like. In particular, when the support structure 12 is inflated, a length of each of the post portions 14 of the support structure 12 may be substantially equal to a distance between neighboring post portions 14. Furthermore, a height of the shelter 10, or a length of each of the post portions 14 of the support structure 12, may be such that a person may stand in the shelter 10, protected by the roof 22 of the shelter 10.

In the illustrated embodiment the support structure 12 comprises a single interconnected passage for air. The support structure 12 includes four substantially straight post portions 14. Each post portion 14 extends between a first end 24 and a second end 26. The first end 24 of each of the post portions 14 is a closed end and forms a lower end or foot 24 of the support structure 12 when the support structure 12 is inflated and erected. The post portions 14 are arranged such that, when inflated, the first ends 24 of the post portions 14 form lower corners 28 of the shelter 10. The second end 26 of each of the post portions 14 is connected to and forms a continuous passage with the roof formation 18 of the support structure 12.

The roof formation 18 comprises four tubular beams 30, each beam 30 extending between the second end 26 of one of the post portions 14 and an intersection 32 (FIG. 11) of the roof formation 18. The second ends 26 of the post portions 14 therefore form upper corners 34 of the shelter 10 when the shelter 10 is inflated.

In this embodiment a length of each of the tubular beams 30, between the intersection 32 and the second end 26 of each of the four post portions 14, is equal such that the intersection 32 is centrally disposed in the roof formation 18. In other embodiments, the intersection 32 may not be centrally disposed in the roof formation 18 but may be disposed closer to one or more of the post portions 14.

The interconnected passage of the support structure may be formed from at least two interconnected flexible tubular sleeves. The passage may be formed by more than two flexible tubular sleeves, and may be formed from up to eight flexible tubular sleeves that are joined together in a suitable manner to form the required support structure.

It will be appreciated that in some embodiments the roof formation may be constructed from four tubular beams that are joined together at their ends at the intersection. In other embodiments the roof formation may be constructed from two tubular beams that form diagonal beams of the roof formation, such that they extend between diagonally opposite post portions.

To allow the shelter 10 to be as compact as possible in the collapsed or storage configuration, it is desirable to minimise the amount of material required to form the shelter 10. In this regard the support structure 12 does not include any passages that extend directly between neighboring post portions 14. The post portions 14 are only connected via the roof formation 18, and in particular via the intersection 32 of the roof formation 18, as described above. The roof formation 18 therefore comprises beams 30 that extend in a generally diagonal direction across the shelter 10.

Figure 5:
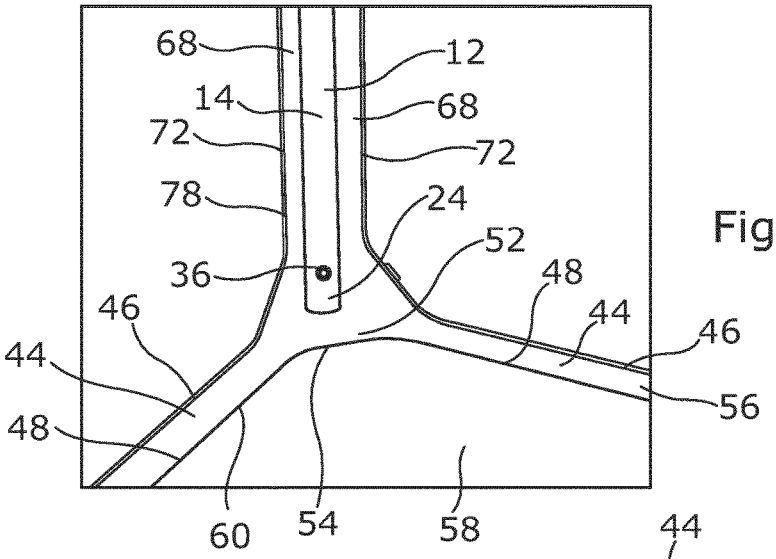
FIG. 5 is an enlarged view of a lower corner of the portable shelter of FIG. 1, showing an inflation point of the support structure.

An advantage of the support structure 12 comprising a single interconnected passage for air is that only one inflation point 36 is required. This means that the support structure 12 can be fully inflated in a single operation. Furthermore, it will be appreciated that it is desirable for the inflation point 36 to be disposed proximate one of the first ends 24 of the post portions 14, as illustrated in FIG. 5. As described further below, in in at least one method of erecting the shelter 10, movement of the first ends 24 of the post portions 14 is minimal during inflation. This means that any pumping device using to pump air into the support structure 12 does not need to move during the inflation process.

The flexible roof panel 20 is secured to the roof formation 18 of the support structure 12 so as to fully span an area defined by the corner posts 16. The roof panel 20 extends outwardly to a substantially square-shaped perimeter of the roof panel 20 which comprises four edges 38. Each of the four edges 38 extends between two neighboring corner posts 16. In this embodiment the roof panel 20 is attached to the support structure 12 such that the roof panel 20 extends over the roof formation 18, and is on an opposite side of the roof formation 18 to the post portions 14. This has an aesthetic advantage, as well as providing a continuous upper surface 40 of the shelter 10 to aid in the discharge and drainage of materials, such as rainwater and leaves, from the roof 22.

In this regard, to allow water to drain off the roof 22 of the shelter 10, the roof 22 may be sloped or inclined so that at least one edge 38 of the flexible roof panel 20 is lower, i.e. closer to the ground when the shelter 10 is erect, than other parts of the roof panel 20. The intersection 32 of the roof formation 18 of the support structure 12 therefore forms an apex 42 of the roof 22.

In the illustrated embodiment the apex 42 is centrally disposed in the roof formation 18 and the roof panel 20 secured to the roof formation 18 slopes downwardly on all sides of the apex 42 towards the edges 38 of the roof panel 20. All four edges 38 of the roof panel 20 are disposed at equal distances from the apex 42.

Although a steeper angle of incline of the roof 22 may be beneficial in respect of drainage of rainwater, there are a number of advantages to minimising an average angle of inclination of the roof 22. These include minimising the height of the shelter 10 to allow the shelter 10 to be erected in a location with low clearance, such as underneath branches of a tree; providing a more cube-like appearance to the shelter 10 for aesthetic reasons; and minimising the amount of material used to form the shelter 10, which in turn minimises the size of the shelter 10 in its collapsed configuration.

An average angle of incline of the roof 22 may be no more than 15°. In some embodiments, an angle of incline of the roof 22 is between about 5° and about 15°.

In other embodiments it may be beneficial to attach the flexible roof panel 20 to an underside of the roof formation 18.

In its most basic form the shelter 10 may comprise only the support structure 12 and the roof panel 20. However, to make the shelter 10 easier to erect and to increase its utility the shelter 10 comprises flexible strips 44 that extend between the first ends 24 of neighboring corner posts 16. So that the shelter 10 automatically assumes the desired cube-like shape when erected, a length of each of the flexible strips 44 may be the same, and in addition, the length of each of the flexible strips 44 may be equal to a length of each of the edges 38 of the roof panel 20.

Each of the elongate flexible strips 44 has a first side edge or external edge 46 and a second side edge or internal edge 48. The external edges 46 of the flexible strips 44 form a lower perimeter edge 50 of the shelter 10 when erected and define the footprint of the shelter 10.

The internal edges 48 of the flexible strips 44 are continuous with each other. A corner portion 52 is therefore disposed inwardly of each of the lower ends of the corner posts 16 and each of the corner portions 52 is disposed between end regions of the flexible strips 44. Internal edges 48 of the elongate flexible strips 44 are continuous with an internal edge 54 of each of the corner portions 52. The flexible strips 44 and corner portions 52 together form a lower perimeter band 56 of the shelter 10.

In some embodiments the internal edge 48, 54 of the lower perimeter band 56 includes a fastener (not shown) configured to engage and connect with a corresponding fastener (not shown) of a detachable groundsheet 58 of the shelter 10. It will be appreciated that the detachable groundsheet 58 may have a perimeter edge 60 that corresponds in shape and size to the internal edge 48, 54 of the lower perimeter band 56, such that the groundsheet 58 may be connected to the perimeter band 56 to form a continuous lower ground cover of the shelter 10. The fastener may be in the form of a zip, but may be of any suitable form such as press studs or hook and loop material, or the like. In other embodiments the groundsheet 58 may be integrally formed with the perimeter band 56.

Side openings 62 of the shelter 10 are defined between each of the corner posts 16 of the shelter 10 when erect. Each of these openings 62 is substantially square. To enable easy access to the shelter 10, and to provide an optimal space within the shelter 10 for any activity, a minimum dimension of each of the side openings 62 may be about 1.8 metres. As such, a minimum height of the side opening 62 between the ground or the lower perimeter band 56 (when present) and an upper edge 64 of the side opening 62 may be greater than 1.8 metres. Similarly, a distance between opposite side edges 66 of the opening 62 or a width of the opening 62 may be greater than 1.8 metres. In one example, a height of the side opening 62 is between 1.8 metres and 2.5 metres, may be between 2 metres and 2.2 metres. The height of the side opening 62 may be 2.1 metres. A width of the opening 62 is between 1.8 metres and 2.5 metres, more preferably between 2 metres and 2.2 metres. The width of the side opening 62 may be 2.1 metres.

It will be appreciated that it is desirable for one or more of the side openings 62 to be closable. To achieve this, wing panels 68 may extend from each of the post portions 14 of the support structure 12. These wing panels 68 may extend for the full length of the post portion 14, with a first end 69 of the each wing panel 68 disposed at the first end 24 of the post portion 14 and a second end 70 of each wing panel 68 disposed at the second end 26 of the respective post portion 14. A longitudinal or free edge 72 of each of the wing panels 68 forms one of the side edges 66 of one of the openings 62 of the shelter 10. Accordingly, two wing panels 68 may extend from each of the post portions 14 and may be arranged such that a plane of a first one of the wing panels 68 is substantially perpendicular to a plane of a second one of the wing panels 68.

An upper wing panel 74 may extend between neighboring post portions 14 such that a first end of the upper wing panel 74 is connected to the second end 26 of a first post portion 14 and a second end of the upper wing panel 74 is connected to the second end 26 of a neighboring second post portion 14. A first long side edge 75 of each of the upper wing panels 74 is connected to a respective perimeter edge 38 of the roof panel 20. It will be appreciated that in some embodiments the upper wing panels 74 are integral with and form part of the roof panel 20. An opposite second long side edge 76 of each of the upper wing panels 74 forms the upper edge 64 of one of the side openings 62 of the shelter 10.

Around each of the side openings 62 the respective side wing panels 68 and upper wing panel 74 may be continuous with each other such that the free edges 72 of each of the side wing panels 68 and the second long side edge 76 of the upper wing panel 74 are continuous and form at least a part of a continuous perimeter edge 78 of the opening 62.

Figure 6:
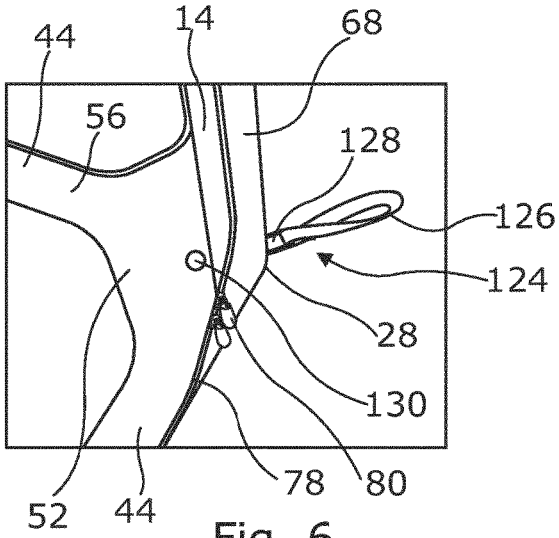
FIG. 6 is an enlarged view of an embodiment of a lower corner of the portable shelter of FIG. 1, showing securing means for securing the shelter to the ground.
Figure 7:
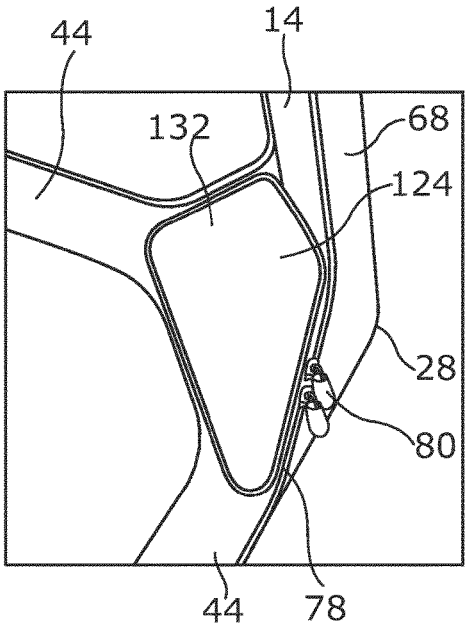
FIG. 7 is an enlarged view of an embodiment of a lower corner of the portable shelter of FIG. 1, showing alternative securing means for securing the shelter to the ground.

The perimeter edge 78 of the opening 62 may include a fastener 80, as shown in FIGS. 6 and 7, configured to engage and connect with a corresponding fastener of a detachable side module 82. The fastener 80 is may be in the form of a zip 80, but may be of any suitable form such as press studs or hook and loop material, or the like.

Figure 13:
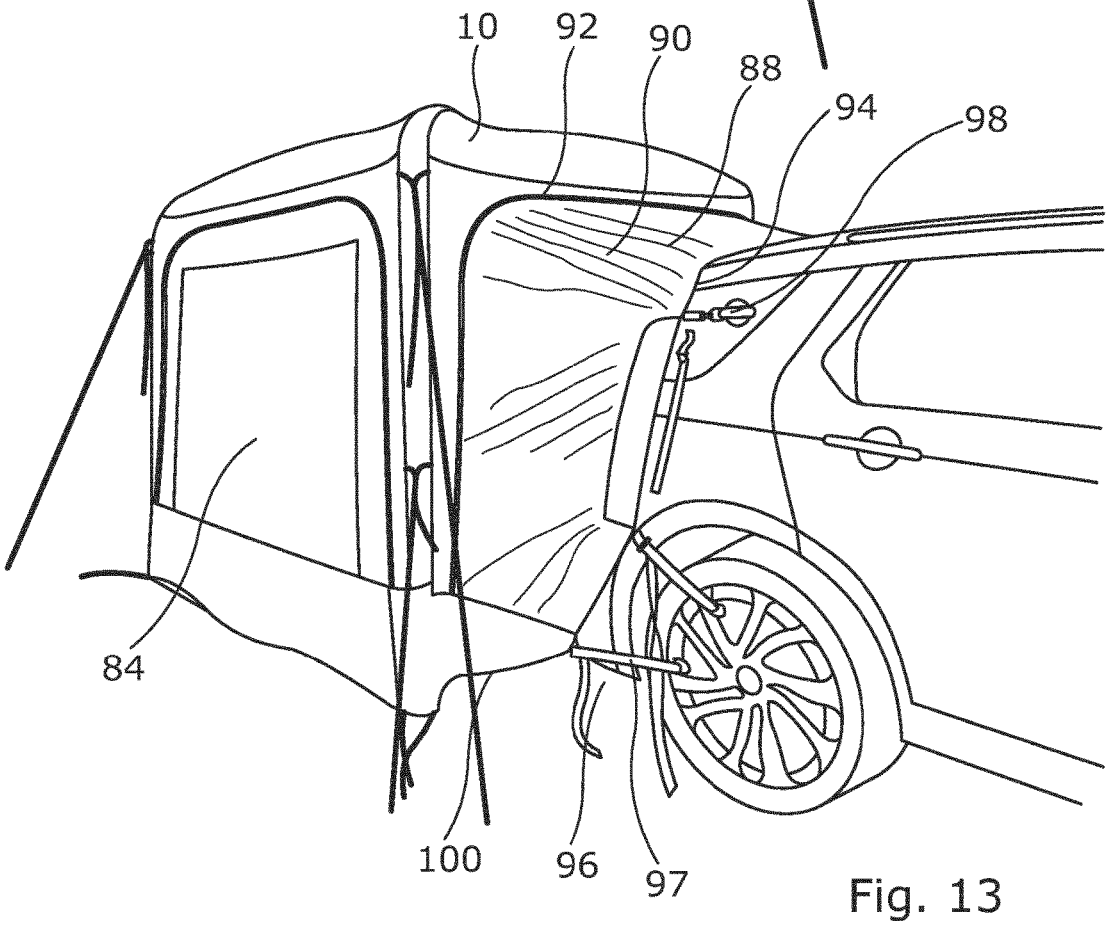
FIG. 13 shows the portable shelter of FIG. 12 with the vehicle canopy attached to a vehicle.

In its simplest form the side module 82 comprises a single flexible panel 84 having dimensions corresponding to the dimensions of the side opening 62 of the shelter 10, as illustrated in FIG. 13. The panel 84 will, therefore, may have a substantially square shape. The fastener of the panel 84 is disposed around a perimeter edge of the panel 84. In some embodiments, a fastener is disposed around three edges of the panel 84 to engage with the fastener 80 disposed along the free edges 72 of each of the side wing panels 68 and the second long side edge 76 of the upper wing panel 74.

In some embodiments in which the shelter 10 comprises a lower perimeter band 56, the lower perimeter band 56 may include a fastener arranged to connect to a fastener of the side module 82. In these embodiments a fastener, such as a zip, may extend fully around all four sides of the perimeter edge 78 of the opening 62, including the free edges 72 of each of the side wing panels 68, the second long side edge 76 of the upper wing panel 74, and the external edge 46 of the flexible strip 44. Accordingly, the panel 84 may include a fastener that extends around all four edges of the substantially square panel 84.

Figure 11:
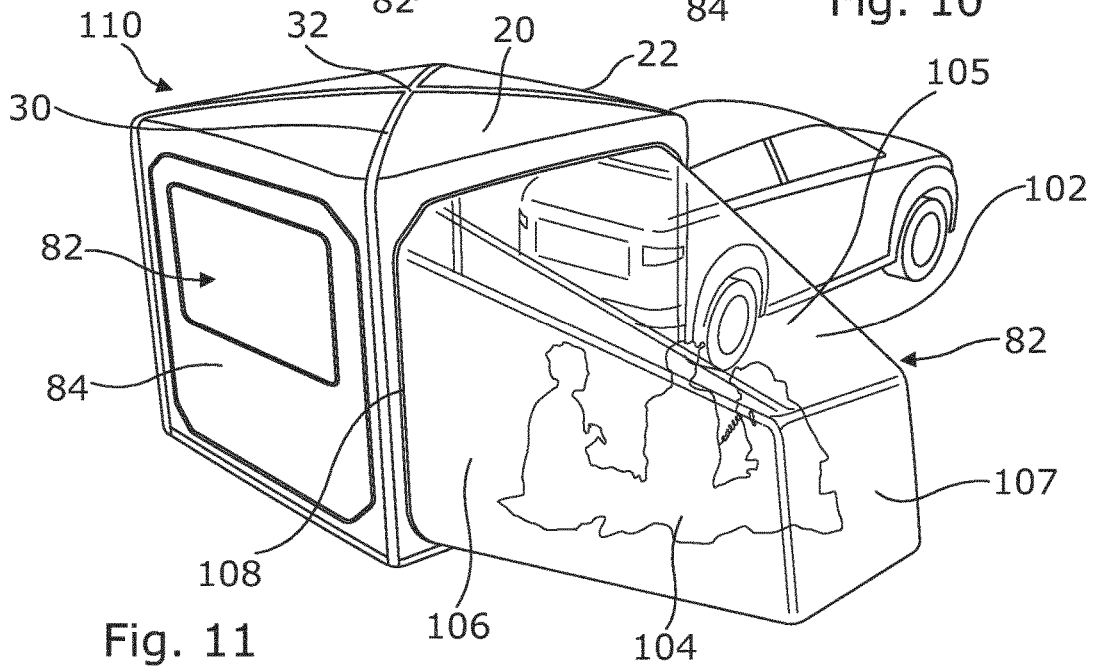
FIG. 11 illustrates a portable shelter according to the invention connected to the rear of a vehicle and including a side pod.
Figure 16:
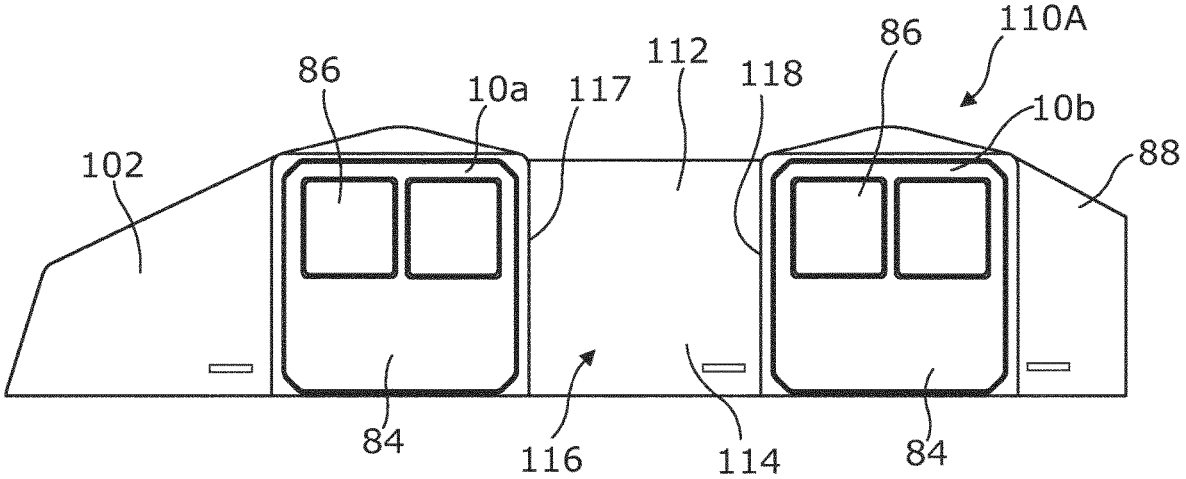
FIG. 16 illustrates a modular assembly comprising two portable shelters according to the present invention.

The panel 84 may include a window 86 or a door, as illustrated in FIGS. 11 and 16. The panel 84 may include a removeable or openable insert or sub-panel, which may provide an access opening of the shelter 10.

Figure 9:
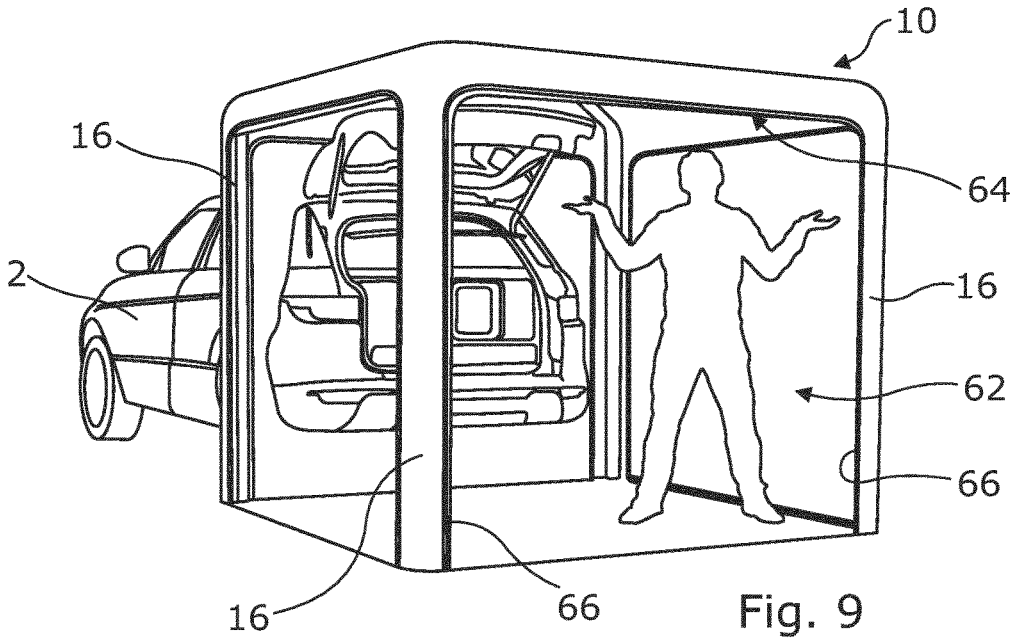
FIG. 9 illustrates a portable shelter according to the invention connected to the rear of a vehicle.

In another embodiment of the side module 82, the side module 82 may be configured to connect the shelter 10 to a vehicle. This vehicular docking side module 88 may comprise a flexible sheet of material 90 that extends between a first edge 92 and an opposite second edge 94. The first edge 92 includes a fastener configured to engage with the fastener 80 of the perimeter edge 78 of the opening 62 of the shelter 10 to connect the docking side module 88 to the shelter 10, as shown most clearly in FIGS. 12 to 14. The second edge 94 is configured to be secured to a vehicle 2 such that the sheet of material 90 extends between the vehicle 2 and the shelter 10. The second edge 94 may be configured to extend around an opening of a vehicle 2, such as a boot or tailgate of a vehicle 2. The docking side module 88 may be configured and sized such that the boot or tailgate of the vehicle 2 may be opened and closed with the side module 88 remaining connected to the vehicle 2, as illustrated in FIG. 9.

Figure 12:
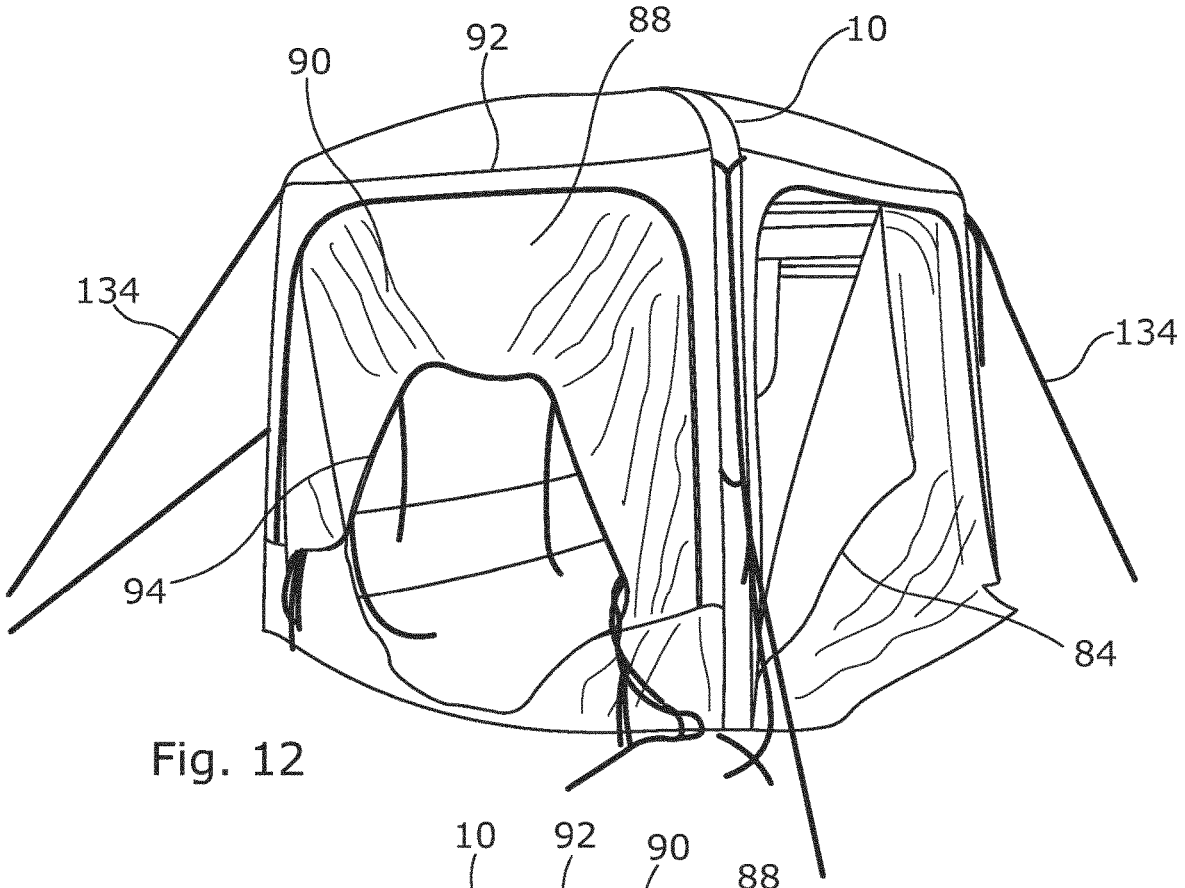
FIG. 12 illustrates a portable shelter according to the invention including a vehicle canopy for attachment to a vehicle.

Referring now to FIGS. 12 and 13, the second edge 94 may be elasticated so that the second edge 94 is able to conform to a shape of the vehicle 2 to minimise any gaps between the second edge 94 of the sheet of material 90 and an external surface of the vehicle 2. Additionally, the second edge 94 may include securing means 96 to connect and secure the sheet of material 90 to the vehicle 2. The securing means 96 may comprise one or more of a strap 97, a suction cup 98, a ratchet and a buckle. In some embodiments the securing means 96 comprises a strap 97 that may be looped around a part of a wheel of a vehicle 2. The wheel strap 97 may be secured in position using a suitable buckle or other fastener. A ratchet mechanism may be provided to allow the strap 97 to be tightened. The securing means 96 may comprise a further strap to which a suction cup 98 is connected. The suction cup 98 may be used to secure the strap to a part of the vehicle 2 such as a roof or a window of the vehicle 2. It will be appreciated that in some embodiments the securing means 96 may include two wheel straps 97 and at least two straps with suction cups 98.

Figure 14:
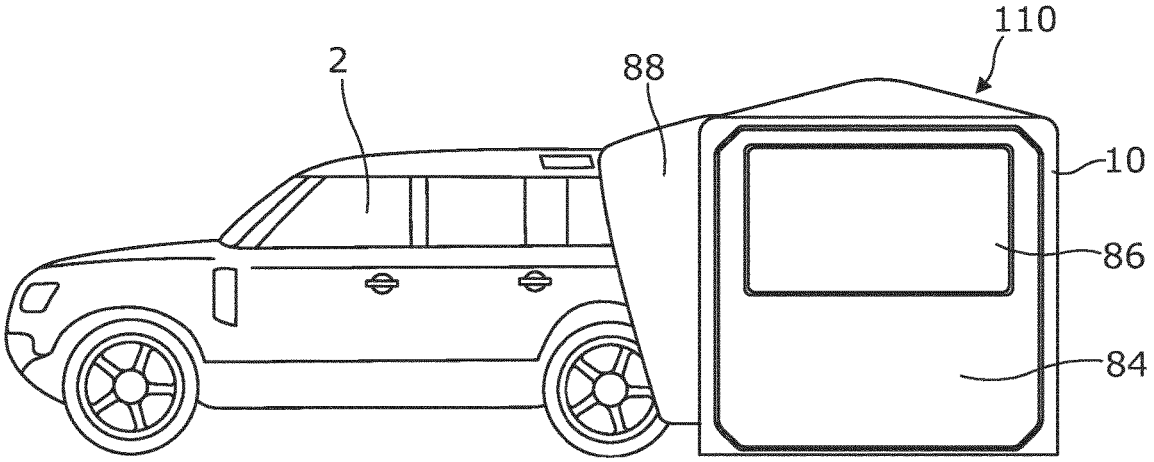
FIG. 14 illustrates a portable shelter according to the invention, including a vehicle canopy attached to a vehicle and a window side wall panel.

With the sheet of material 90 connected to a vehicle 2 and the shelter 10, as illustrated in FIG. 14, lower ends 100 of the sheet 90 may be free ends. The sheet 90 may be arranged such that these free ends 100 are disposed above the level of the ground when the docking side module 88 is connected, such that there is a gap between each of the free ends 100 and the ground.

Figure 10:
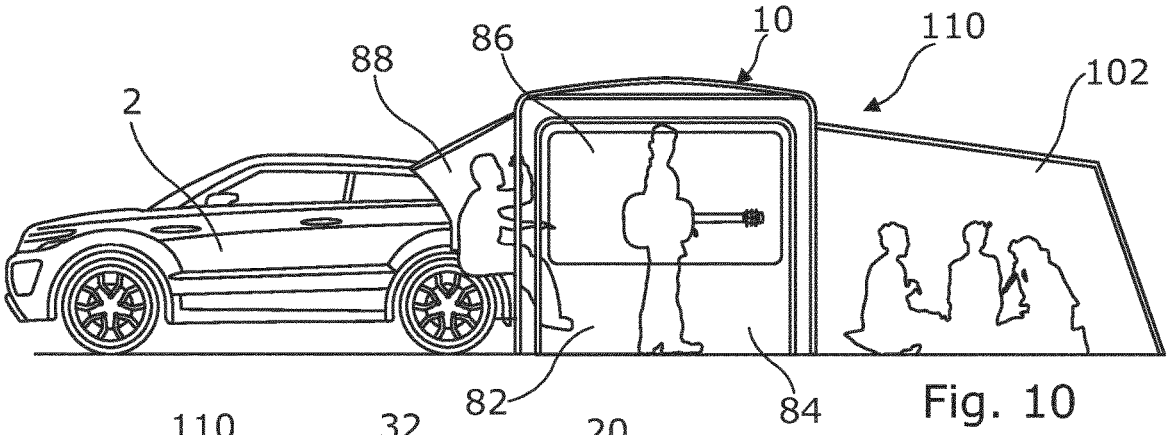
FIG. 10 illustrates a portable shelter according to the invention connected to the rear of a vehicle and including a side pod.

In another embodiment of the side module 82, the side module 82 may be in the form of a pod 102. An example of such a pod 102 is illustrated in FIGS. 10 and 11. It is envisaged that the pod 102 will provide a space for sitting and/or sleeping. The pod 102 may comprise one or more flexible sheets 104 arranged to provide a roof portion 105, two side wall portions 106, an end wall portion 107 and a floor portion. The two side wall portions 106 and the end wall portion 107 extend from three edges of the roof portion 105 and a fourth edge of the roof portion 105 forms part of a connecting edge 108 of the pod 102. The end wall portion 107 is disposed between the two side wall portions 106 and these portions 106, 107 are connected to each other such that there are two free edges of the side wall portions 106 adjacent the fourth edge of the roof portion 105. These free edges of the side wall portions 106 also form part of the connecting edge 108 of the pod 102. Finally, the floor portion is connected to the side wall portions 106 and the end wall portion 107 such that the side wall portions 106 and end wall portion 107 extend between the floor portion and the roof portion 105. Three edges of the floor portion are connected to the side wall portions 106 and the end wall portion 107, and a fourth edge of the floor portion forms a further part of the connecting edge 108 of the pod 102. The fourth edges of the roof portion 105 and floor portion and the free edges of the side wall portions 106 form a continuous connecting edge 108 of the pod 102.

The shape and dimensions of the connecting edge 108 of the pod 102 may be such that the connecting edge 108 can be joined to the shelter 10 around one of the side openings 62. In this regard, the connecting edge 108 of the pod 102 may include a fastener configured to engage with the fastener 80 of the perimeter edge 78 of the opening 62 of the shelter 10 to connect the pod 102 to the shelter 10.

In order for the pod 102 to maintain the required shape when erected it will be appreciated that the pod 102 may comprise a suitable support structure or skeleton. This support structure may be in the form of semi-rigid or rigid poles or inflatable hollow tubes. To minimise the material of the pod 102, such that the pod 102 is relatively compact when in a collapsed configuration, a height of the pod 102, i.e. a distance between the roof portion 105 and the floor portion when erected, may be less than the height of the shelter 10. In some embodiments a maximum height of the pod 102 may be no greater than the height of the side opening 62 of the shelter 10, as illustrated in FIGS. 10 and 11. Furthermore, it may be desirable for the two side wall portions 106 to be tapered such that a height of the end wall portion 107 is less than a height or length of each of the free edges of the side wall portions 106.

It will be appreciated that a user may erect a modular assembly 110 comprising one or more shelters 10 together with one or more side modules 82. In addition, the fasteners 80 provided at the perimeter edge 78 of the opening 62 of the shelter 10 may be configured such that two shelters 10 may be connected directly to each other. In other words, a perimeter edge 78 of a first opening 62 of a first shelter 10 may be fastened directly to a perimeter edge 78 of a second opening 62 of a second shelter 10.

Further side modules 82 may be provided that allow shelters 10 to be connected together in a variety of different modular arrangements. A number of examples are shown in FIGS. 15 to 20.

Figure 15:
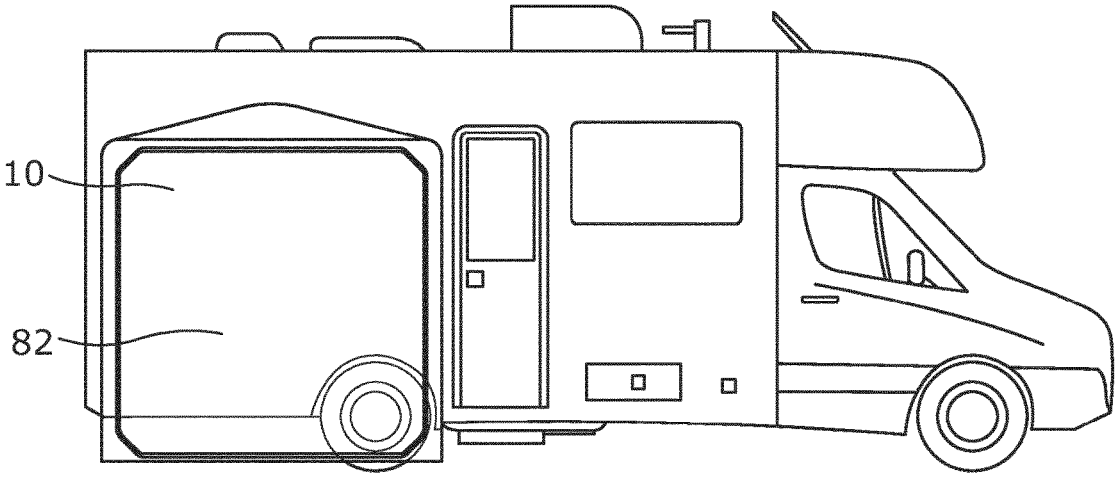
FIG. 15 illustrates a portable shelter according to the invention adjacent a motor home.

One type of side module 82 may allow a shelter 10 to be attached to the side of a vehicle such as a motorhome or caravan, as illustrated in FIG. 15. This side module 82 may comprise a panel and securing means to connect and secure the panel, and therefore the shelter, to the vehicle. The securing means may comprise one or more of a strap, a suction cup, a ratchet and a buckle.

Another type of side module 82 may be in the form of a through passage 112 for connecting two shelters 10 in a spaced apart arrangement. This is illustrated in FIG. 16. The through passage side module 112 comprises one or more panels or sheets of flexible material 114 configured to form a tube or sleeve 116. The tube 116 extends between a first end 117 and a second end 118 along a length of the tube 116. Each of the first end 117 and the second end 118 has a perimeter having a length equal to the length of the perimeter edge 78 of an opening 62 of the shelter 10. Furthermore, each of the first and second ends 117, 118 comprises a fastener configured to engage with a fastener of a perimeter edge 78 of an opening 62 of a shelter 10 to connect the through passage 112 to a pair of shelters 10. In particular, in use, the first end 117 of the tube 116 may be fastened to the perimeter edge 78 of a first opening 62 of a first shelter 10*a*, and the second end 118 of the tube 116 may be fastened to the perimeter edge 78 of a second opening 62 of a second shelter 10*b*, such that the through passage 112 extends between the first and second shelters 10*a*, 10*b*. A length of the through passage 112 may therefore define a distance between the first and second shelters 10*a*, 10*b*.

With the through passage 112 attached to the first and second shelters 10*a*, 10*b*, the shape of the openings 62 of the shelters 10*a*, 10*b* may cause the through passage 112 to automatically assume a tubular shape including a roof portion, a floor portion and two side wall portions. Accordingly, in some embodiments of the through passage 112, the through passage 112 may not include any form of support structure or skeleton. In other embodiments it may be desirable for the through passage 112 to include some form of support structure, which may comprise semi-rigid or rigid poles or inflatable hollow tubes. In further embodiments the through passage 112 may not include a floor portion.

The embodiment of a modular assembly 110A in FIG. 16 illustrates a first shelter 10*a* and a second shelter 10*b* connected by a through passage side module 112. A pod 102 is connected to an opening 62 of the first shelter 10*a* opposite to the through passage 112. A docking side module 88 is connected to an opening 62 of the second shelter 10*b* opposite to the through passage 112. The pod 102, first shelter 10*a*, through passage 112, second shelter 10*b* and docking side module 88 therefore form a linear arrangement. Remaining openings 62 of the first and second shelters 10*a*, 10*b* may be left open, or a panel 84 may be fastened to an opening 62 to provide a door or a window 86, for example.

Figure 17:
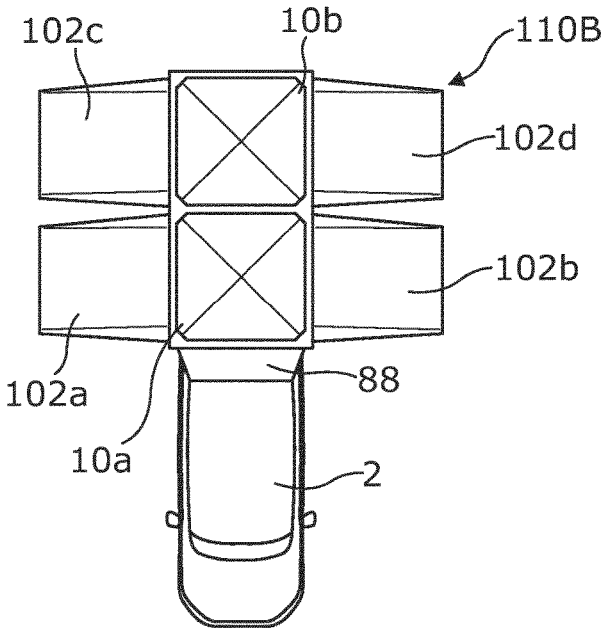
FIG. 17 illustrates a further modular assembly comprising two portable shelters and a vehicle canopy attached to a vehicle.

FIG. 17 illustrates a modular assembly 110B in which a first shelter 10*a* is connected to a vehicle 2 by a docking side module 88. A second shelter 10*b* is connected directly to the first shelter 10*a*, as described above. The modular assembly 110B further comprises four pods 102. A first pod 102*a* and a second pod 102*b* are connected to and extend from the first shelter 10*a* and a third pod 102*c* and a fourth pod 102*d* are connected to and extend from the second shelter 10*b*.

Figure 18:
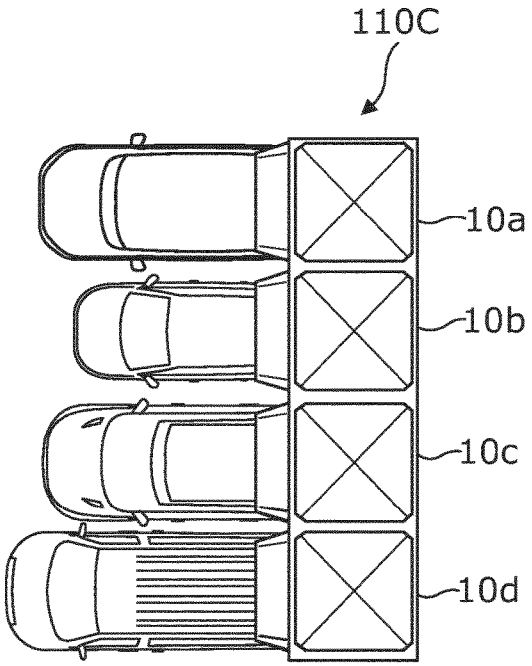
FIG. 18 illustrates a modular assembly including four portable shelters.

FIG. 18 illustrates a modular assembly 110C in which four shelters 10 are directly connected to each other in a linear arrangement. A first shelter 10*a* is directly attached to a first opening 62 of a second shelter 10*b*. A first opening 62 of a third shelter 10*c* is directly attached to a second opening 62 of the second shelter 10*b*, the second opening 62 of the second shelter 10*b* being opposite the first opening 62 of the second shelter 10*b*. A second opening 62 of the third shelter 10*c* is directly attached to an opening 62 of a fourth shelter 10*d*, the second opening 62 of the third shelter 10*c* being opposite the first opening 62 of the third shelter 10*c*.

In other embodiments a plurality of shelters 10 may be directly connected together in an arrangement other than a linear arrangement. For example, a first opening of a first shelter may be directly attached to a first opening of a second shelter. A first opening of a third shelter may be directly attached to a second opening of the second shelter, the second opening of the second shelter being orthogonal to the first opening of the second shelter. A second opening of the third shelter may be directly attached to a first opening of a fourth shelter, the second opening of the third shelter being orthogonal to the first opening of the third shelter. A second opening of the fourth shelter may then be directly attached to a second opening of the first shelter, the second opening of the first shelter being orthogonal to the first opening of the first shelter. In this modular assembly, therefore, the four shelters are in a square array.

Figure 19:
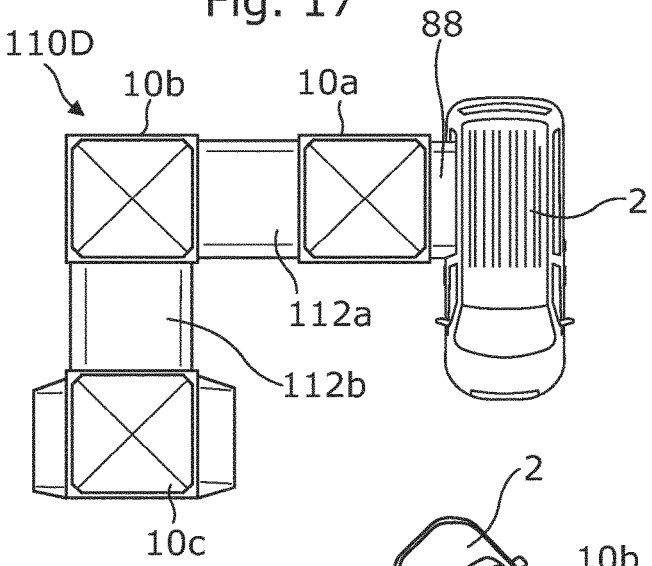
FIG. 19 shows a further modular assembly comprising a plurality of portable shelters according to the invention.

FIG. 19 illustrates a further exemplary modular assembly 110D comprising three shelters 10. A first shelter 10*a* is attached to a side of a vehicle 2 by a docking side module 88. In this embodiment the docking side module 88 is configured to be secured to a side of the vehicle 2, in particular around a side door of the vehicle 2. A second shelter 10*b* is connected to the first shelter 10*a* by a first through passage 112*a*. A third shelter 10*c* is connected to the second shelter 10*b* by a second through passage 112*b*. In this example the second through passage 112*b* extends in a direction orthogonal to the first through passage 112*a*.

Figure 20:
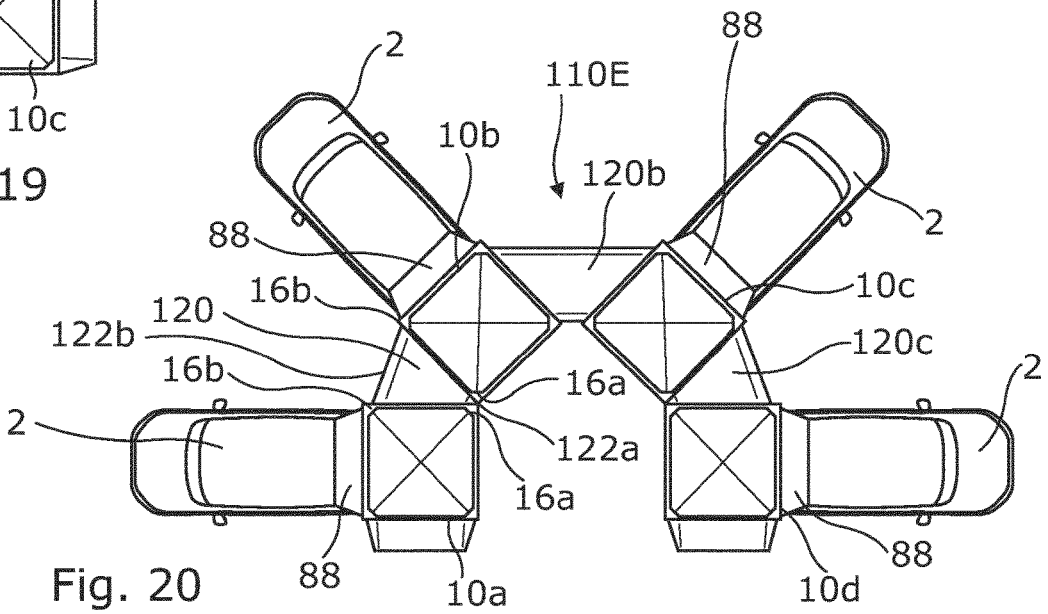
FIG. 20 shows a further modular assembly comprising a plurality of portable shelters.

FIG. 20 illustrates a modular assembly 110E in which four shelters 10 are arranged in a substantially crescent-shaped configuration. In this modular assembly 110E a first opening of a first shelter 10*a*, defined between first and second corner posts 16*a*, 16*b* of the first shelter 10*a*, is connected to a first opening of a second shelter 10*b*, defined between first and second corner posts 16*a*, 16*b* of the second shelter 10*b*. The first opening of the first shelter 10*a* is connected to the first opening of the second shelter 10*b* by a first angled through passage side module 120.

The angled through passage side module 120 has many features in common with the through passage side module 112 described above. The difference is that a length of a first one of the side wall portions 122*a* of the angled through passage side module 120 is less than a length of a second one of the side wall portions 122*b* of the angled through passage side module 120. In this way a plane of the first end of the angled through passage side module 120 is not parallel to a plane of the second end of the angled through passage side module 120.

Accordingly, when the angled through passage side module 120 is connected between the first openings of the first and second shelters 10*a*, 10*b*, a distance between the first corner posts 16*a* of the first and second shelters 10*a*, 10*b* is less the a distance between the second corner posts 16*b* of the first and second shelters 10*a*, 10*b*, such that the first and second shelters 10*a*, 10*b* are angled with respect to each other.

In the illustrated embodiment a second angled through passage side module 120*b* connects a second opening of the second shelter 10*b* to a first opening of a third shelter 10*c*, and a third angled through passage side module 120*c* connects a second opening of the third shelter 10*c* to a first opening of a fourth shelter 10*d*. In this embodiment a docking side module 88 is attached to a third opening of each of the shelters 10 such that each of the shelters 10 may be attached individually to a respective vehicle 2.

A method of erecting a shelter 10 will now be described with particular reference to FIGS. 4 to 8 and 12.

In an initial step in the method the shelter 10 is partially opened from its collapsed configuration. The four lower corners 28 of the shelter 10 are spaced apart so that there is the correct distance between the first ends 24 of the post portions 14 of the support structure 10. In embodiments including flexible strips 44 extending between the first ends 24 of the corner posts 16, this step will include extending, unfolding or unrolling each of the flexible strips 44 to its full length. In embodiments including an integral groundsheet, this step will include opening the groundsheet to a flattened configuration.

The shelter 10 is placed on the ground and the four lower corners 28 of the shelter 10 may be secured to the ground in this partially opened configuration. To facilitate this, the shelter 10 may comprise securing means 124 at each of the four lower corners. Referring to FIG. 6, the securing means 124 may comprise a loop 126 of material such as webbing that is secured to a buckle 128 at each of the four lower corners 28 and extends outwardly from the shelter 10. In use a suitable peg or post (not shown), for example a hooked tent peg, may be inserted through the loop 126 to secure the corner 28 of the shelter 10 to the ground. Additionally or alternatively a through-hole 130 may be disposed in each of the corner portions 52 of the lower perimeter band 56. In use a suitable peg or post may be inserted through each hole 130 to secure the shelter 10 to the ground.

In some embodiments the securing means 124 may comprise the buckle 128 at each of the four corners 28 without a loop. A suitable peg or post may then be engaged directly with the buckle 128 to secure the shelter 10 to the ground. In further embodiments the securing means 124 may comprise a tether that may be tied to a suitable attachment structure.

In some situations it may not be possible or desirable to secure the shelter 10 to the ground using pegs or posts. In an alternative embodiment, shown in FIG. 7, pouches 132 may be disposed at each of the corner portions 52 of the lower perimeter band 56. These pouches 132 may be integrally formed with the lower perimeter band 56. Alternatively the pouches 132 may be separate from, and securable to, the lower perimeter band 56. An internal volume of each of the pouches 132 may be fileable with a substance such as sand or water. The filled pouches 132 disposed on or seated on the corner portions 52 of the lower perimeter band 56 may then be used to weigh down the lower corners 28 of the shelter 10.

Once the lower corners 28 of the shelter 10 have been secured, a user may then connect a suitable pump to the inflation point 36 of the support structure 12. The pump may then be activated to pump air (or other suitable gas) into the interconnected passage of the support structure 12. It will be appreciated that the inflation point 36 or inflation port may be of any suitable design and configuration. The inflation port 36 may comprise a one-way valve to prevent or minimise loss of air from the support structure 12 when the pump is detached. The inflation point 36 may comprise a cover or cap to seal the inflation port 36 when there is no pump attached.

Figure 8:
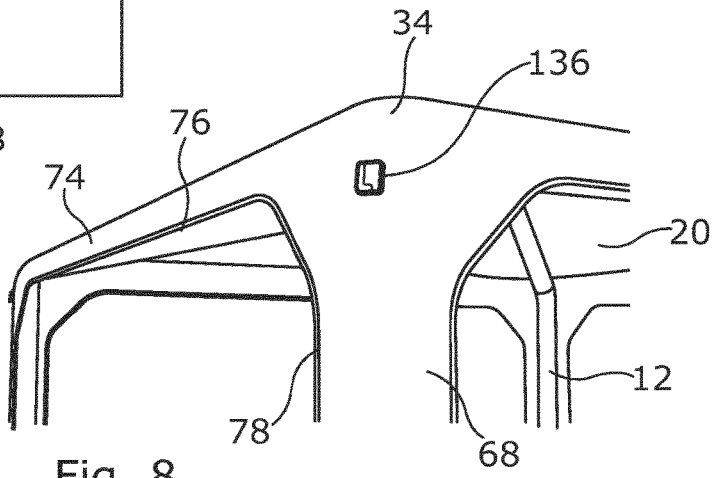
FIG. 8 is an enlarged view of upper corners of the portable shelter of FIG. 1, showing an anchor buckle for attachment of a guy line to the shelter.

Once the support structure 12 is fully inflated, guy lines or storm lines 134 may be connected between the upper corners 34 of the shelter 10 and the ground. To facilitate this, upper securing means 136, such as brackets, buckles or connectors, may be disposed on an outer surface of the shelter 10 proximate the second end 26 of each of the corner posts 16, as shown in FIG. 8.

One or more side modules 82 may be connected to the shelter 10 to form a modular assembly 110 if required. In embodiments in which a docking side module 88 is fastened to the shelter 10, the docking side module 88 may then be secured to a vehicle 2, for example by engaging one or more straps 97 with a part of the vehicle 2 and/or securing one or more suction cups 98 to a surface of the vehicle 2.

To collapse the shelter 10 for storage a first step is to detach any side modules 82 from the shelter 10 as well as any guy lines 134 that have been secured to upper corners 34 of the shelter 10. The shelter 10 may then be deflated by opening the inflation port 36, which may include opening a valve of the inflation port 36, to allow a release of air from the passageway of the support structure 12. Alternatively the support structure 12 may include an additional port which may be opened to allow air to exit the support structure 12.

Once the support structure is fully deflated the shelter may be folded or rolled into a collapsed storage configuration. This storage configuration has dimensions such that the shelter may be stowed in a part of a vehicle such as a boot or trunk without occupying too much space. The shelter may be stowed in a suitable bag or case. This bag or case may be securable to and detachable from a part of a vehicle.

The invention claimed is:

1. A portable shelter comprising:

an inflatable support structure including a single interconnected passage for air, the passage comprising four substantially straight post portions defining upright corner posts of the support structure and a roof formation connecting upper ends of the post portions and having four interconnecting tubes, an intersection between said four interconnecting tubes defining an apex of the roof formation, wherein said post portions are only connected via said roof formation and said shelter lacks any inflatable passages between said post portions;

the roof formation comprising said four interconnecting tubes each extending between the upper end of the one of the post portions and the intersection of the roof formation and wherein the four interconnecting tubes extending in a diagonal direction across the shelter;

an uninflated perimeter band extending between lower ends of the straight post portions, a detachable groundsheet connected to the perimeter band;

at least one flexible roof panel extending between the four interconnecting tubes of the roof formation to form a roof of the portable shelter and a perimeter edge of the at least one flexible roof panel extending between neighboring pairs of said post portions;

wing panels extending upwardly along said upright post portions;

openings defined by said wing panels between each neighboring pair of the post portions, the openings being substantially square and having a minimum dimension of 1800 mm when the portable shelter is in a fully inflated configuration;

detachable side modules disposed along each of said openings;

a perimeter edge of each of the openings between neighboring post portions includes a fastener, the fasteners being configured to engage with each other such that, in use, a first fastener of a first shelter is engageable with a second fastener of a second shelter to join the first shelter to the second shelter;

and wherein an average angle of inclination of the roof, between the upper ends of the post portions and the apex of the roof formation, is less than 15°.

2. The portable shelter as claimed in claim 1, wherein the intersection is centrally disposed in the roof formation.

3. The portable shelter as claimed in claim 1, wherein an average angle of inclination of the roof is between 5° and 15°.

4. The portable shelter as claimed in claim 1, further comprising flexible strips extending between first, lower ends of neighboring corner posts, a length of each of the flexible strips being the same and the flexible strips forming part of the lower perimeter band of the portable shelter.

5. The portable shelter as claimed in claim 4, further comprising a plurality of pouches disposed in corner regions of the lower perimeter band, each of the pouches having an internal volume fillable with a substance.

6. The portable shelter as claimed in claim 4, further comprising the groundsheet integrally formed with the lower perimeter band or securable to a fastener disposed at an edge of the lower perimeter band.

7. The portable shelter as claimed in claim 1, wherein the distance between opposite side edges of each of the openings is between 1.8 metres and 2.5 metres.

8. The portable shelter as claimed in claim 1, wherein a minimum height of each of the openings is between 1.8 metres and 2.5 metres.

9. A modular shelter assembly comprising:

a portable shelter having an inflatable support structure including a single interconnected passage for air, the passage comprising four substantially vertical post portions defining upright corner posts of the support structure and a roof formation connecting upper ends of the post portions and having at least two interconnecting tubes, an intersection between said at least two interconnecting tubes defining an apex of the roof formation;

wherein said post portions are only connected via said roof formation and said shelter lacks any inflatable passages between said post portions;

the roof formation comprising four tubular beams defining said at least two interconnecting tubes, said tubular beams each extending between the upper end of the one of the post portions and the intersection of the roof formation and wherein the four tubular beams extend in a diagonal direction across the shelter;

an uninflatable perimeter band extending between corner portions at lower ends of the vertical post portions, a detachable groundsheet connected to the perimeter band;

at least one flexible roof panel extending between the at least two interconnecting tubes of the roof formation to form a roof of the portable shelter; and openings between each adjacent pair of the post portions, the openings being defined by wing panels extending upwardly along said vertical post portions, and said openings being substantially square and having a minimum dimension of 1800 mm when the portable shelter is in a fully inflated configuration, and wherein an average angle of inclination of the roof, between the upper ends of the post portions and the apex of the roof formation, is less than 15°; and a detachable side module connected to the portable shelter at each of said openings.

10. The modular shelter assembly as claimed in claim 9, wherein the side module comprises a fastener configured to engage with a fastener of a perimeter edge of each of the openings.

11. The modular shelter assembly as claimed in claim 10, wherein the side module comprises a flexible sheet extending between a first edge and a second edge, the first edge including a fastener configured to engage with the fastener of the perimeter edge of the opening of the portable shelter, and the second edge being elasticated.

12. The modular shelter assembly as claimed in claim 11, wherein the second edge comprises securing structure including one or more of a strap, a suction cup, a ratchet and a buckle.

13. The modular shelter assembly as claimed in claim 9, wherein the side module comprises a flexible panel including a removeable or openable sub-panel.

14. The modular shelter assembly as claimed in claim 10, wherein the side module comprises a pod including one or more flexible sheets arranged to provide a roof portion, two side wall portions, an end wall portion and a floor portion, and a connecting edge of the pod including a fastener configured to engage with the fastener of the perimeter edge of the opening of the portable shelter.

15. The modular shelter assembly as claimed in claim 14, wherein the pod comprises a support structure including semi-rigid or rigid poles or inflatable hollow tubes.

16. The modular shelter assembly as claimed in claim 14, wherein a height of the pod is the same as or less than a height of the opening of the portable shelter.

17. The modular shelter assembly as claimed in claim 10, wherein the side module comprises one or more flexible panels configured to form a tube extending between a first end and a second end, each of the first end and the second end having a perimeter having a length equal to the length of the perimeter edge of the opening of the portable shelter.

18. The modular shelter assembly as claimed in claim 17, wherein the one or more flexible panels comprises a first side wall portion and a second side wall portion, and a length of the first side wall portion is less than a length of the second side wall portion.

19. A method of erecting a shelter comprising:

securing first ends of four corner post portions of a portable shelter on the ground such that distances between neighboring corner post portions are substantially equal and the first ends of the corner post portions are at least 1800 mm apart, each of said corner post portions being vertical;

inflating a support structure of the portable shelter, the support structure including a single interconnected passage for air comprising the four corner post portions and a roof formation connecting second ends of the post portions, an intersection between four interconnecting tubes of the roof formation defining an apex of the roof formation, said roof formation defining said apex being the only inflatable passage connecting said corner post portions, wherein, when the support structure is fully inflated, an integral flexible roof panel extends between the four interconnecting tubes of the roof formation to form a roof of the portable shelter, openings between each of the neighboring corner post portions are substantially square, and an average angle of inclination of the roof, between the second ends of the corner post portions and the apex of the roof formation, is between 5° and 15°, said openings defined by wing panels extending upwardly along said corner post portion;

a perimeter edge of each of the openings between neighboring post portions includes a fastener, the fasteners being configured to engage with each other such that, in use, a first fastener of a first shelter is engageable with a second fastener of a second shelter to join the first shelter to the second shelter, before securing the first ends of four corner post portions of the shelter on the ground, extending flexible strips between the first ends of neighboring corner post portions, such that the extended flexible strips form a lower perimeter band of the portable shelter, said lower perimeter band being uninflatable;

attaching a detachable groundsheet to the lower perimeter band that extends between the corner post portions;

attaching a detachable module between each adjacent pair of the corner post portions.

20. The method as claimed in claim 19, further comprising filling an internal volume of each of a plurality of pouches with a substance, and disposing each of the pouches at a corner region of the lower perimeter band.

21. The method as claimed in claim 19, further comprising connecting a pump to a single inflation point of the support structure of the portable shelter.

22. The method as claimed in claim 19, further comprising attaching one or more side modules to the portable shelter.

23. The method as claimed in claim 22, further comprising engaging a fastener of the one or more side modules with the fastener disposed at the perimeter edge of each of the openings between the neighboring corner post portions.

* * * * *